US007024997B2

(12) United States Patent
Mori

(10) Patent No.: US 7,024,997 B2
(45) Date of Patent: Apr. 11, 2006

(54) PRINTING METHOD EMPLOYING PLANOGRAPHIC PRINTING PLATE MATERIAL

(75) Inventor: Takahiro Mori, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 93 days.

(21) Appl. No.: 10/749,194

(22) Filed: Dec. 30, 2003

(65) Prior Publication Data

US 2004/0154490 A1 Aug. 12, 2004

(30) Foreign Application Priority Data

Jan. 22, 2003 (JP) ..... 2003-013269

(51) Int. Cl.
*B41N 3/00* (2006.01)

(52) U.S. Cl. ..... 101/463.1; 101/147; 430/302

(58) Field of Classification Search ..... 101/147, 101/148, 463.1, 467; 430/302
See application file for complete search history.

(56) References Cited

U.S. PATENT DOCUMENTS 3,233,619 A * 2/1966 Gegenheimer et al. ..... 137/1
5,622,620 A 4/1997 Meenan et al.
6,651,555 B1 * 11/2003 Szarka ..... 101/148
2002/0009574 A1 1/2002 Hiraoka
2002/0088360 A1 7/2002 Mori
2002/0142247 A1 * 10/2002 Kawamura et al. ..... 430/270.1
2002/0172891 A1 11/2002 Mori

FOREIGN PATENT DOCUMENTS

| | | |
|---|---|---|
| EP | 1 203 663 A1 | 5/2002 |
| EP | 1 266 751 | 12/2002 |
| JP | 10-175284 | 6/1998 |
| JP | 2001-260310 | 9/2001 |
| JP | 2002-59531 | 2/2002 |

* cited by examiner

*Primary Examiner*—Andrew H. Hirshfeld
*Assistant Examiner*—Jill E. Culler
(74) *Attorney, Agent, or Firm*—Lucas & Mercanti, LLP

(57) ABSTRACT

Disclosed is a printing method employing a planographic printing plate material capable of being developed on a printing press, the method comprising the step of imagewise exposing a planographic printing plate material comprising a support, and provided thereon, an image formation layer containing hydrophobic precursor particles, developing the exposed planographic printing plate material with dampening water and/or printing ink to obtain a printing plate, the dampening water being re-circulated for re-use and filtered with a filter during re-circulation, and carrying out printing employing the resulting printing plate.

10 Claims, No Drawings

PRINTING METHOD EMPLOYING PLANOGRAPHIC PRINTING PLATE MATERIAL

FIELD OF THE INVENTION

The present invention relates to a method of carrying out printing employing a planographic printing plate material capable of being developed on a printing press, and particularly to a method of carrying out printing employing a planographic printing plate material capable of forming an image by a computer to plate (CTP) system, and capable of being developed on a printing press.

BACKGROUND OF THE INVENTION

The planographic printing plate material for CTP, which is inexpensive, can be easily handled, and has a printing ability comparable with that of a PS plate, is required accompanied with the digitization of printing data. Recently, a processless planographic printing plate material which can be applied to a printing press employing a direct imaging (DI) process without development by a special developing agent has been required.

As a method of forming an image in the processless planographic printing plate material, a useful one forms an image employing an infrared laser. The methods are divided into three kinds detailed later, i.e., a method employing a non-processing type planographic printing plate material, a method employing an ablation type planographic printing plate material, and a method employing a development on-press type heat fusible image formation planographic printing plate material.

Examples of the non-processing type planographic printing plate material include a planographic printing plate material disclosed in JP 3064807 and 3206297, which comprises a cross-linked hydrophilic resin layer capable of being made lipophilic by heating. This material is ideal as a processless planographic printing plate material, but is difficult to make a difference between hydrophilicity and lipophilicity in the resin layer after image formation, and has problems in that ink receptivity is insufficient at image portions, and stain is likely to occur at non-image portions.

Examples of the ablation type planographic printing plate material include those disclosed in for example, Japanese Patent O.P.I. Publication Nos. 8-507727, 6-186750, 6-199064, 7-314934, 10-58636 and 10-244773. These references disclose a planographic printing plate material comprising a substrate and a hydrophilic layer or a lipophilic layer as an outermost layer. In the planographic printing plate material having a hydrophilic layer as an outermost layer, the hydrophilic layer is imagewise exposed to imagewise ablate the hydrophilic layer, whereby the lipophilic layer is exposed to form image portions. However, there is problem that contamination of the interior of the exposing apparatus by scattered matter caused by the ablation of the surface layer. In order to prevent such a scattered matter caused by the ablation of the surface layer, there is a planographic printing plate material in which a water soluble protective layer is further provided on the hydrophilic layer wherein the ablated layer is removed together with the protective layer on the printing press. The ablation type planographic printing plate material, in which it is possible to design a hydrophilic layer and an oleophilic layer, individually, produces no serious problem regarding ink receptivity at image portions and stain at non-image portions, however, has problem in that it is low in sensitivity, forms an image with low resolution and low quality, and may produce fringes at image portions.

As a method developing a development on-press type heat fusible image formation planographic printing plate material, the following method is known: a method (see JP 2938397) of imagewise exposing a planographic printing plate material comprising a hydrophilic substrate and provided thereon, an image formation layer containing a hydrophobic thermoplastic polymer particles dispersed in a hydrophilic binder, which is heat fusible, or a planographic printing plate material comprising a hydrophilic substrate and provided thereon, an image formation layer or its adjacent layer, containing a light-to-heat conversion material; mounting the imagewise exposed planographic printing plate material on a plate cylinder of a printing press; and then developing the resulting planographic printing plate material by providing dampening water and/or printing ink on the material while rotating the plate cylinder to manufacture a planographic printing plate, or a method (see JP 2938398) of mounting, on a plate cylinder of a printing press, a planographic printing plate material comprising a hydrophilic substrate and provided thereon, an image formation layer containing a hydrophobic thermoplastic polymer particles dispersed in a hydrophilic binder, which is heat fusible, or a planographic printing plate material comprising a hydrophilic substrate and provided thereon, an image formation layer or its adjacent layer, containing a light-to-heat conversion material; imagewise exposing the planographic printing plate material, employing laser or LED; and then developing the resulting planographic printing plate material by providing dampening water and/or printing ink on the material while rotating the plate cylinder to manufacture a planographic printing plate. These methods employ a planographic printing plate material comprising a hydrophilic layer or a grained aluminum plate and provided thereon, an image formation layer containing thermoplastic particles and a water soluble binder, which is higher in sensitivity, dissolving power, and image quality than a planographic printing plate material of ablation type.

As a planographic printing plate material enhancing printing durability, there is a planographic printing plate material comprising a hydrophilic layer surface, and provided thereon, an image formation layer containing a hydrophobic thermoplastic particles, a hydrophilic polymer binder, (which is water soluble, water dispersible, alkali soluble or alkali dispersible), and optionally an infrared absorbing compound, wherein the hydrophobic polymer particles comprise a material having one selected from the group consisting of an amido group, a urethane group, a methacrylonitrile residue, a chrotononitrile residue, a vinylidene cyanide residue, an isocytosine residue, a pyrrolidone residue, a piperazine fesidue, a cyanomethyl group, a cyanoethyl group, a cyanopropyl group, and a cyanoaryl group (see Japanese Patent O.P.I. Publication No. 2002-251005).

At present, a processless planographic printing plate material, which is considered to have a sufficient printability, is subjected to development on a printing press (development on-press) to form an image. The development on-press is a process providing dampening water and/or printing ink on an exposed planographic printing plate material mounted on a plate cylinder of a printing press bringing an ink roller or a dampening water roller into contact with the material while rotating the plate cylinder to remove a part of the image formation layer. Further, a part of the image formation layer may be removed by bringing the plate cylinder into contact with a blanket of a printing press. In this case, as the image formation layer incorporated into printing ink is gradually transferred onto a printing paper sheet through the blanket, a serious problem is not caused as long as the image formation layer is not extremely colored.

In contrast, as the image formation layer incorporated into dampening water is accumulated in the dampening water, problem may be produced that printing conditions vary, when printing is continued for a long term. As dampening water is usually contaminated with ink emulsion or paper powder during printing, dampening water filtered and re-circulated during printing is employed. There is description in JP 2938397 and JP 2938398 above that an image formation layer to be subjected to development on-press contains thermoplastic particles with a particle size of 90 nm, and there is description in Japanese Patent O.P.I. Publication No. 2002-251005 above that an image formation layer to be subjected to development on-press contains thermoplastic particles with a particle size of 65 nm. However, in a conventional filtration of dampening water, incorporation of such minute particles into dampening water is not considered.

Accordingly, when printing has been carried out for a long term employing a printing press using a conventional filtration of dampening water and employing a processless planographic printing plate material, particularly a processless planographic printing plate material comprising an image formation layer containing hydrophobic precursor particles, composition of the dampening water varies, which may lead to change of printing conditions.

A dampening water cleaning device, purifying dampening water without requiring exchange of a filter medium clogged with floating matter, and preventing ink from accumulating in the dampening water, is known in which dampening water, overflowing a dampening water boat, is introduced to an intermediate tank, and then to a dampening water cooling and re-circulating tank, and re-supplied to the dampening water boat, wherein an ultrafiltration ceramic membrane of a cross-flow system is used as the filter medium (see Japanese Patent O.P.I. Publication No. 2002-59531). A technique is known in which removes fine particles of ink, oil or paper powder contained in dampening water through a potential adsorption filter and further bleaches and deodorizes the dampening water through an activated carbon filter to regenerate a dampening water, and reuses the regenerated dampening water, wherein the dampening water is recycled without being discarded (see Japanese Patent O.P.I. Publication No. 2000-351193). However, these techniques are not applied to a printing method employing a planographic printing plate material capable of being developed on a printing press.

SUMMARY OF THE INVENTION

An object of the invention is to provide a printing method of carrying out printing employing a planographic printing plate material capable of being developed on a printing press, which can maintain stable printing conditions even when a dampening water is re-circulated and reused.

DETAILED DESCRIPTION OF THE INVENTION

The above object has been attained by one of the following constitutions:

1. A printing method employing a planographic printing plate material capable of being developed on a printing press, the method comprising the steps of imagewise exposing a planographic printing plate material comprising a support, and provided thereon, an image formation layer containing hydrophobic precursor particles, developing the exposed planographic printing plate material with dampening water and/or printing ink to obtain a printing plate, the dampening water being re-circulated for re-use and filtered with a filter during re-circulation, and carrying out printing employing the resulting printing plate.

2. The printing method of item 2 above, wherein the hydrophobic precursor particles are thermoplastic particles or microcapsules encapsulating oleophilic materials therein.

3. The printing method of item 1 above, wherein a filtration accuracy of the filter is not more than the average particle size of the hydrophobic precursor particles.

4. The printing method of item 1 above, wherein the filter employs an adsorption ability due to zeta potential, whereby the dampening water is filtered.

5. The printing method of item 1 above, wherein the filter employs an ultrafiltration method, whereby the dampening water is filtered.

6. The printing method of item 1 above, wherein the imagewise exposing is carried out employing an infrared laser installed in a printing press.

7. The printing method of item 1 above, wherein the image formation layer contains the hydrophobic precursor particles in an amount of from 5 to 100% by weight.

8. The method of item 1 above, wherein the image formation layer further contains a water soluble resin.

9. The method of item 8 above, wherein the water soluble resin is oligosaccharide.

10. The method of item 9 above, wherein the oligosaccharide is trehalose.

1-1. A printing method employing a planographic printing plate material capable of being developed on a printing press, the printing plat material comprising a support, and provided thereon, an image formation layer, a part of which is capable of being removed with dampening water and ink, the method comprising the step of imagewise exposing the planographic printing plate material, developing the exposed planographic printing plate material with dampening water and printing ink to obtain a printing plate, and carrying out printing employing the resulting printing plate, while the dampening water is filtered by a filter and re-circulated.

1-2. The method of item 1-1 above, wherein the image formation layer contains hydrophobic precursor particles.

1-3. The method of item 1-2 above, wherein the hydrophobic precursor particles are thermoplastic particles or microcapsules encapsulating oleophilic materials therein.

1-4. The method of item 1-2 or 1-3 above, wherein a filtration accuracy of the filter, which is defined as the minimum particle size of particles capable of removed by the filter, is not more than the average particle size of the hydrophobic precursor particles.

1-5. The method of any one of items 1-1 through 1-4 above, wherein the filter has an adsorption filtration ability due to zeta potential.

1-6. The method of any one of items 1-1 through 1-4 above, wherein the filter employs an ultrafiltration method.

1-7. The method of any one of items 1-1 through 1-6 above, wherein the imagewise exposing is carried out employing infrared laser source installed in a printing press.

The invention is a printing method employing a planographic printing plate material capable of being developed on a printing press, the printing plate material comprising a support, and provided thereon, an image formation layer, a part of which is capable of being removed with dampening water and/or ink, the method comprising the step of imagewise exposing the planographic printing plate material, developing the exposed planographic printing plate material with dampening water and printing ink to obtain a printing plate, and carrying out printing employing the resulting printing plate, while the dampening water is filtered and recirculated.

Herein, "a planographic printing plate material capable of being developed on a printing press" means a planographic printing plate material capable of being developed with dampening water and/or printing ink provided in a printing press without employing any other specific developer, the printing plate material being mounted on the printing press.

The filtration method of dampening water may be one in which the dampening water, always filtered through a filter provided in the dampening water supply path, is supplied to a printing plate on a plate cylinder; one in which the dampening water is filtered through a filter in a dampening water re-circulation system, and the filtered dampening water is then supplied to a printing press, and then to a printing plate on a plate cylinder; or a combination thereof.

A planographic printing plate material used in the printing method of the invention employing a planographic printing plate material capable of being developed on a printing press is not specifically limited as long as it is a planographic printing plate material in which the planographic printing plate material being mounted on a printing press, a part of the image formation layer of the material is capable of being removed with dampening water. In the invention, the ablation type planographic printing plate material as described above comprising the water soluble protective layer can be also used, but a planographic printing plate material comprising an image formation layer containing hydrophobic precursor particles is preferably used.

[Hydrophobic Precursor Particles]

The hydrophobic precursor particles are not specifically limited, and may be any particles as long as they can form an oleophilic image formation layer due to heat generated by irradiation of infrared laser. The hydrophobic precursor particles are preferably thermoplastic particles or microcapsules encapsulating oleophilic materials.

[Thermoplastic Particles]

The thermoplastic particles include particles well-known in the art such as heat melting particles and heat fusible particles. The particle size of the thermoplastic particles is preferably from 50 nm to 5 μm, more preferably from 80 nm to 2 μm, and still more preferably from 100 nm to 1 μm.

(Heat Melting Particles)

The heat melting particles used in the invention are particularly particles having a low melt viscosity, or particles formed from materials generally classified into wax. The materials preferably have a softening point of from 40° C. to 120° C. and a melting point of from 60° C. to 150° C., and more preferably a softening point of from 40° C. to 100° C. and a melting point of from 60° C. to 120° C. The melting point less than 60° C. has a problem in storage stability and the melting point exceeding 150° C. lowers ink receptive sensitivity.

Materials usable in the invention include paraffin, polyolefin, polyethylene wax, microcrystalline wax, and fatty acid wax. The molecular weight thereof is approximately from 800 to 10,000. A polar group such as a hydroxyl group, an ester group, a carboxyl group, an aldehyde group and a peroxide group may be introduced into the wax by oxidation to increase the emulsification ability. Moreover, stearoamide, linolenamide, laurylamide, myristylamide, hardened cattle fatty acid amide, parmitylamide, oleylamide, rice bran oil fatty acid amide, palm oil fatty acid amide, a methylol compound of the above-mentioned amide compounds, methylenebissteastearoamide and ethylenebissteastearoamide may be added to the wax to lower the softening point or to raise the working efficiency. A cumarone-indene resin, a rosin-modified phenol resin, a terpene-modified phenol resin, a xylene resin, a ketone resin, an acryl resin, an ionomer and a copolymer of these resins may also be usable.

Among them, polyethylene, microcrystalline wax, fatty acid ester and fatty acid are preferably contained. A high sensitive image formation can be performed since these materials each have a relative low melting point and a low melt viscosity. These materials each have a lubrication ability, and therefore, even when a shearing force is applied to the surface layer of the planographic printing plate material, the layer damage is minimized, and resistance to contaminations which may be caused by scratch is further enhanced.

The heat melting particles are preferably dispersible in water. The average particle size thereof is preferably from 0.01 to 10 μm, and more preferably from 0.1 to 3 μm. When a layer containing the heat melting particles is coated on the porous hydrophilic layer to be described later, the particles having an average particle size less than 0.01 μm may enter the pores of the hydrophilic layer or the valleys between the neighboring two peaks on the hydrophilic layer surface, resulting in insufficient development on press and background contaminations. The particles having an average particle size exceeding 10 μm are not preferred, since it may result in lowering of dissolving power.

The composition of the heat melting particles may be continuously varied from the interior to the surface of the particles. The particles may be covered with a different material. Known microcapsule production method or sol-gel method can be applied for covering the particles.

(Heat Fusible Particles)

The heat fusible particles in the invention include thermoplastic hydrophobic polymer particles. Although there is no specific limitation to the upper limit of the softening point of the thermoplastic hydrophobic polymer particles, the softening point is preferably lower than the decomposition temperature of the polymer particles. The weight average molecular weight (Mw) of the polymer is preferably within the range of from 10,000 to 1,000,000.

Examples of the polymer consisting the polymer particles include a diene (co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; a (meth)acrylate (co)polymer or a (meth)acrylic acid (co)polymer such as polymethyl methacrylate, a methyl methacrylate-(2-ethylhexyl)acrylate copolymer, a methyl methacrylate-methacrylic acid copolymer, or a methyl acrylate-(N-methylolacrylamide); polyacrylonitrile; a vinyl ester (co)polymer such as a polyvinyl acetate, a vinyl acetate-vinyl propionate copolymer and a vinyl acetate-ethylene copolymer, or a vinyl acetate-2-hexylethyl acrylate copolymer; and polyvinyl chloride, polyvinylidene chloride, polystyrene and a copolymer thereof. Among them, the (meth)acrylate polymer, the (meth)acrylic acid (co)polymer, the vinyl ester (co)polymer, the polystyrene and the synthetic rubbers are preferably used. Hydrophobic polymer particles containing nitrogen in an amount of more than 0.1% by weight, disclosed in Japanese Patent O.P.I. Publication Nos. 2002-251005, can be preferably used.

The polymer particles may be prepared from a polymer synthesized by any known method such as an emulsion polymerization method, a suspension polymerization method, a solution polymerization method and a gas phase polymerization method. The particles of the polymer synthesized by the solution polymerization method or the gas phase polymerization method can be produced by a method in which an organic solution of the polymer is sprayed into an inactive gas and dried, and a method in which the polymer is dissolved in a water-immiscible solvent, then the resulting solution is dispersed in water or an aqueous medium and the solvent is removed by distillation. In both of the methods, a surfactant such as sodium lauryl sulfate, sodium dodecylbenzenesulfate or polyethylene glycol, or a water-soluble resin such as poly(vinyl alcohol) may be optionally used as a dispersing agent or stabilizing agent. Further, triethylamine or triethanolamine may be used.

The heat fusible particles are preferably dispersible in water. The average particle size of the heat fusible particles is preferably from 0.01 to 10 μm, and more preferably from 0.1 to 3 μm. When a layer containing the heat fusible particles having an average particle size less than 0.01 μm is coated on the porous hydrophilic layer, the particles may enter the pores of the hydrophilic layer or the valleys between the neighboring two peaks on the hydrophilic layer surface, resulting in insufficient development on press and background contaminations. The heat fusible particles having an average particle size exceeding 10 μm may result in lowering of dissolving power.

Further, the composition of the heat fusible particles may be continuously varied from the interior to the surface of the particles. The particles may be covered with a different material. As a covering method, known methods such as a microcapsule method and a sol-gel method are usable.

[Microcapsules]

Examples of the microcapsules include those encapsulating oleophilic materials disclosed in Japanese Patent O.P.I. Publication Nos. 2002-2135 and 2002-19317.

The oleophilic materials are preferably hydrophobic materials, and examples thereof include polystyrene, polymethyl methacrylate, polyethylene, polybutadiene, polyvinyl chloride, an epoxy resin, a phenol resin, a polyester resin, a polyurethane resin, a melamine resin, a polyamide resin, an alkyd resin, a xylene resin, a urea resin, and a hydroxystyrene resin.

The hydrophobic resin is preferably a resin softened or melted by heat generated due to irradiation of infrared laser, and more preferably a resin cross-linked by heating. This shows that the resin having a heat reactive group such as an epoxy group or a methylol group is preferred.

The preferred wall of the microcapsules used in the invention is preferably a wall having a property which is capable of being three-dimensionally cross-linked and swelled by solvents. Materials of the wall having such a property include polyurea, polyurethane, polyester, polycarbonate, polyamide and a mixture thereof. Polyurea and polyurethane are especially preferred. The materials for the microcapsule wall may have a heat reactive group.

The average microcapsule size of the microcapsules is preferably from 0.1 to 10 μm, more preferably from 0.3 to 5 μm, and still more preferably from 0.5 to 3 μm. The thickness of the microcapsule wall is preferably from 1/100 to 1/5 of the average microcapsule size, and more preferably from 1/50 to 1/10 of the average microcapsule size. The microcapsule content of the image formation layer is preferably from 5 to 100% by weight, more preferably from 20 to 95% by weight, and most preferably from 40 to 90% by weight.

Further, as the materials for the microcapsule wall, known materials can be used. As a method of manufacturing the microcapsules, known methods can be used. The materials for the microcapsule wall and the manufacturing method of the microcapsule wall can be applied which are disclosed in for example, Tamotsu Kondo, Masumi Koishi, "New Edition Microcapsule, Its Manufacturing Method, Properties And Application", published by Sankyo Shuppan Co., Ltd., or disclosed in literatures cited in it.

The content of the hydrophobic precursor particles above in the image formation layer is preferably from 5 to 100% by weight, more preferably from 20 to 95% by weight, and most preferably from 40 to 90% by weight.

[Circulation of Dampening Water and Filter Used in Filtration of Dampening Water]

As a circulation apparatus or circulation method of dampening water, various known ones can be used. Particularly, technique disclosed in Japanese Patent O.P.I. Publication Nos. 2000-351193 and 2002-59531 is preferably used.

A filter is preferred in which a filtration accuracy is preferably not more than an average particle size of the hydrophobic precursor particles. The filtration accuracy herein referred to is defined as the minimum particle size of particles capable of being removed by a filter. The kinds of the filter are not specifically limited, and may be filters employing various filtration systems. Filtration systems can be used which is disclosed in for example, Japanese Patent O.P.I. Publication Nos. 7-117215, 8-132754, 9-239947, 10-175284, 10-175285, 10-296002, 2001-205109, and 2001-260310.

One preferred embodiment of the invention is a printing method comprising employing a filter having adsorption filtration ability due to zeta potential. Such a filter can catch charged particles in a solution due to adsorption and can remove particles with a particle size smaller than a physical pore size of a filter medium used in the filter. As such a filter, there are filters of Zeta Plus series Cuno Co., Ltd. In the Zeta Plus series, there are filters having a filtration accuracy of 0.1 to 0.2 μm, which can remove most of the hydrophobic precursor particles in the invention with a preferred particle size.

This filter, having adsorption filtration ability due to zeta potential, can be used in combination with another filter, for example, a filter employing activated carbon disclosed in Japanese Patent O.P.I. Publication No. 2000-351193.

Another preferred embodiment of the invention is a printing method comprising employing a filter employing an ultrafiltration method. The ultrafiltration method can remove hydrophobic precursor particles used in the invention with a preferred particle size range.

A filter employing ultrafiltration is preferably a filter employing an ultrafiltration ceramic membrane of a cross-flow system as described in Japanese Patent O.P.I. Publication No. 2002-59531. Examples thereof include a dampening water cleaning device, Liquid Through SSS MKII produced by Mihara Ryouju Engineering Co., Ltd.

[Image Formation by Infrared Laser Exposure]

In the invention, a planographic printing plate material is exposed preferably employing infrared laser to form an image. Particularly, scanning exposure is preferred which is carried out employing a laser which can emit light having a wavelength of infrared and/or near-infrared regions, that is, a wavelength of from 700 to 1500 nm. As the laser, a gas laser can be used, but a semi-conductor laser, which emits light having a near-infrared region wavelength, is preferably used.

A device suitable for the scanning exposure in the invention may be any device capable of forming an image on the printing plate material according to image signals from a computer employing a semi-conductor laser.

Generally, the following scanning exposure processes are mentioned.

(1) A process in which a plate precursor provided on a fixed horizontal plate is scanning exposed in two dimensions, employing one or several laser beams.

(2) A process in which the surface of a plate precursor provided along the inner peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

(3) A process in which the surface of a plate precursor provided along the outer peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

In the invention, the process (3) above is preferable, and especially preferable when a printing plate material mounted on a plate cylinder of a printing press is scanning exposed.

In the invention, the planographic printing plate material comprising a support and provided thereon, an image formation layer is preferred which the image formation layer or another layer (for example, a layer adjacent to the image formation layer) contains a light-to-heat conversion material.

<<Light-to-Heat Conversion Material>>

The light-to-heat conversion materials include materials as described below.

(Infrared Absorbing Dyes)

Examples of the infrared absorbing dyes include general infrared absorbing dyes such as a cyanine dye, a chloconium dye, a polymethine dye, an azulenium dye, a squalenium dye, a thiopyrylium dye, a naphthoquinone dye or an anthraquinone dye, and an organometallic complex such as a phthalocyanine compound, a naphthalocyanine compound, an azo compound, a thioamide compound, a dithiol compound or an indoaniline compound. Exemplarily, the light-heat conversion materials include compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589, and 3-103476. These compounds may be used singly or in combination.

(Pigment)

Examples of pigment include carbon, graphite, a metal and a metal oxide. Furnace black and acetylene black is preferably used as the carbon. The graininess ($d_{50}$) thereof is preferably not more than 100 nm, and more preferably not more than 50 nm.

(Graphite)

The graphite is one having a particle size of preferably not more than 0.5 μm, more preferably not more than 100 nm, and most preferably not more than 50 nm.

(Metal)

As the metal, any metal can be used as long as the metal is in a form of fine particles having preferably a particle size of not more than 0.5 μm, more preferably not more than 100 nm, and most preferably not more than 50 nm. The metal may have any shape such as spherical, flaky and needle-like. Colloidal metal particles such as those of silver or gold are particularly preferred.

(Metal Oxide)

As the metal oxide, materials having black color in the visible regions or materials which are electro-conductive or semi-conductive can be used. Examples of the former include black iron oxide ($Fe_3O_4$), and black complex metal oxides containing at least two metals. Examples of the latter include Sb-doped $SnO_2$ (ATO), Sn-added $In_2O_3$ (ITO), $TiO_2$, TiO prepared by reducing $TiO_2$ (titanium oxide nitride, generally titanium black). Particles prepared by covering a core material such as $BaSO_4$, $TiO_2$, $9Al_2O_3 \cdot 2B_2O$ and $K_2O \cdot nTiO_2$ with these metal oxides is usable. The particle size of these particles is preferably not more than 0.5 μm, more preferably not more than 100 nm, and most preferably not more than 50 nm.

Among these light heat conversion materials, black complex metal oxides containing at least two metals are preferred. Typically, the black complex metal oxides include complex metal oxides comprising at least two selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441.

The complex metal oxide used in the invention is preferably a complex Cu—Cr—Mn type metal oxide or a Cu—Fe—Mn type metal oxide. The Cu—Cr—Mn type metal oxides are preferably subjected to the treatment disclosed in Japanese Patent O.P.I. Publication Nos. 8-27393 in order to reduce isolation of a 6-valent chromium ion. These complex metal oxides have a high color density and a high light heat conversion efficiency as compared with another metal oxide.

The primary average particle size of these complex metal oxides is preferably from 0.001 to 1.0 μm, and more preferably from 0.01 to 0.5 μm. The primary average particle size of from 0.001 to 1.0 μm improves a light heat conversion efficiency relative to the addition amount of the particles, and the primary average particle size of from 0.05 to 0.5 μm further improves a light heat conversion efficiency relative to the addition amount of the particles. The light heat conversion efficiency relative to the addition amount of the particles depends on a dispersity of the particles, and the well-dispersed particles have a high light heat conversion efficiency. Accordingly, these complex metal oxide particles are preferably dispersed according to a known dispersing method, separately to a dispersion liquid (paste), before being added to a coating liquid for the particle containing layer. The metal oxides having a primary average particle size of less than 0.001 are not preferred since they are difficult to disperse. A dispersant is optionally used for dispersion. The addition amount of the dispersant is preferably from 0.01 to 5% by weight, and more preferably from 0.1 to 2% by weight, based on the weight of the complex metal oxide particles.

The content of the complex metal oxide is preferably 0.1 to 50% by weight, more preferably 1 to 30% by weight, and most preferably 3 to 25% by weight based on the weight of the layer in which the complex metal compound oxide is contained.

The planographic printing plate material in the invention comprises an image formation layer on a support, and may comprise anther layer such as a hydrophilic layer or an under layer.

[Image Formation Layer]

In the invention, the image formation layer containing hydrophobic precursor particles can further contain a water soluble material. When an image formation layer at unexposed portions is removed on a press with dampening water or ink, the water soluble material makes it possible to easily remove the layer.

Regarding the water soluble material, those described above as water soluble materials to be contained in the hydrophilic layer can be used. The image formation layer in the invention preferably contains saccharides, and more preferably contains oligosaccharides. Since the oligosaccharides are easily dissolved in water, removal on a press of unexposed portions of an oligosaccharide-containing layer can be easily carried out dissolving the saccharide in water. The removal does not require a specific system, and can be carried out conducting the same manner as in the beginning of printing of a conventional PS plate, which does not increase loss of prints at the beginning of printing. Use of the oligosaccharide does not lower hydrophilicity of the hydrophilic layer and can maintain good printing performance of the hydrophilic layer. The oligosaccharide is a water-soluble crystalline substance generally having a sweet taste, which is formed by a dehydration condensation reaction of plural monosaccharide molecules. The oligosaccharide is one kind of o-glycoside having a saccharide as the aglycon. The oligosaccharide is easily hydrolyzed by an acid to form a monosaccharide, and is classified according to the number of monosaccharide molecules of the resulting hydrolysis compounds, for example, into disaccharide, trisaccharide, tetrasaccharide, and pentasscharide. The oligosaccharide referred to in the invention means di- to deca-saccharides.

The oligosaccharide is classified into a reducing oligosaccharide and a non-reducing oligosaccharide according to presence or absence of a reducing group in the molecule. The oligosaccharide is also classified into a homo-oligosaccharide composed of the same kind of monosaccharide and a hetero-oligosaccharide composed of two or more kinds of monosaccharides. The oligosaccharide naturally exists in a free state or a glycoside state. Moreover, various oligosaccharides are formed by glycosyl transition by action of an enzyme.

The oligosaccharide frequently exists in a hydrated state in an ordinary atmosphere. The melting points of the hydrated one and anhydrous one are different from each other as shown in the following Table 1.

TABLE 1

| Kinds of oligosaccharide | | Melting point (° C.) Hydrates | Anhydrides |
|---|---|---|---|
| Raffinose | Trisaccharide | 80 (Pentahydrate) | 118 |
| Trehalose | Disaccharide | 97 (Dihydrate) | 215 |
| Maltose | Disaccharide | 103 (Monohydrate) | 108 |
| Galactose | Disaccharide | 119 (Monohydrate) | 167 |
| Sucrose | Disaccharide | None | 182 |
| Lactose | Disaccharide | 201 (Monohydrate) | 252 |

In the invention, the layer containing a saccharide is preferably formed coating an aqueous coating solution containing the saccharide on a support. When an oligossccharide in the layer formed from the aqueous coating solution is one capable of forming a hydrate, the melting point of the oligosaccharide is that of its hydrate. Since the oligosaccharides, having a relatively low melting point, also melt within the temperature range at which heat melting particles melt or heat fusible particles fuse, they do not cause image formation inhibition resulting from permeation of the heat melting particles into the porous hydrophilic layer and/or fusion adhesion of the heat fusible particles to the hydrophilic layer.

Among the oligosaccharides, trehalose with comparatively high purity is available on the market, and has an extremely low hygroscopicity, although it has high water solubility, providing excellent storage stability and excellent development property on a printing press.

When oligosaccharide hydrates are heat melted to remove the hydrate water and solidified, the oligosaccharide is in a form of anhydride for a short period after solidification. Trehalose is characterized in that a melting point of trehalose anhydride is not less than 100° C. higher that that of trehalose hydrate. This characteristics provides a high melting point and reduced heat fusibility at exposed portions of the trehalose-containing layer immediately after heat-fused by infrared ray exposure and re-solidified, preventing image defects at exposure such as banding from occurring. In order to attain the object of the invention, trehalose is preferable among oligosaccharides.

The oligosaccharide content of the image formation layer is preferably from 1 to 90% by weight, and more preferably from 10 to 80% by weight, based on the total weight of the layer.

[Hydrophilic Layer]

Materials used in the hydrophilic layer in the planographic printing plate material in the invention include the following.

(Material for Forming a Hydrophilic Matrix Phase in the Hydrophilic Layer)

A material for forming a hydrophilic matrix phase in the hydrophilic layer is preferably a metal oxide. The metal oxide preferably comprises metal oxide particles. Examples of the metal oxide particles include a colloidal silica, an alumina sol, a titania sol and another metal oxide sol. The metal oxide particles may have any shape such as spherical, needle-like, and feather-like shape. The average particle size is preferably from 3 to 100 nm, and plural kinds of metal oxide each having a different size may be used in combination. The surface of the particles may be subjected to surface treatment.

The metal oxide particles can be used as a binder, utilizing its layer forming ability. The metal oxide particles are suitably used in a hydrophilic layer since they minimize lowering of the hydrophilicity of the layer as compared with an organic compound binder.

Among the above-mentioned, colloidal silica is particularly preferred. The colloidal silica has a high layer forming ability under a drying condition with a relative low temperature, and can provide a good layer strength. It is preferred that the colloidal silica used in the invention is necklace-shaped colloidal silica or colloidal silica particles having an average particle size of not more than 20 nm, each being described later. Further, it is preferred that the colloidal silica provides an alkaline colloidal silica solution as a colloid solution.

The necklace-shaped colloidal silica to be used in the invention is a generic term of an aqueous dispersion system of a spherical silica having a primary particle size of the order of nm. The necklace-shaped colloidal silica to be used in the invention means a "pearl necklace-shaped" colloidal silica formed by connecting spherical colloidal silica particles each having a primary particle size of from 10 to 50 μm so as to attain a length of from 50 to 400 nm. The term of "pearl necklace-shaped" means that the image of connected colloidal silica particles is like to the shape of a pearl necklace. The bonding between the silica particles forming the necklace-shaped colloidal silica is considered to be —Si—O—Si—, which is formed by dehydration of —SiOH groups located on the surface of the silica particles. Concrete examples of the necklace-shaped colloidal silica include Snowtex-PS series produced by Nissan Kagaku Kogyo, Co., Ltd. As the products, there are Snowtex-PS-S (the average particle size in the connected state is approximately 110 nm), Snowtex-PS-M (the average particle size in the connected state is approximately 120 nm) and Snowtex-PS-L (the average particle size in the connected state is approximately 170 nm). Acidic colloidal silicas corresponding to each of the above-mentioned are Snowtex-PS—S—O, Snowtex-PS-M-O and Snowtex-PS-L-O, respectively.

The necklace-shaped colloidal silica is preferably used in a hydrophilic layer as a porosity providing material for hydrophilic matrix phase, and porosity and strength of the layer can be secured by its addition to the layer. Among them, the use of Snowtex-PS-S, Snowtex-PS-M or Snowtex-PS-L, each being alkaline colloidal silica particles, is particularly preferable since the strength of the hydrophilic layer is increased and occurrence of background contamination is inhibited even when a lot of prints are printed.

It is known that the binding force of the colloidal silica particles is become larger with decrease of the particle size. The average particle size of the colloidal silica particles to be used in the invention is preferably not more than 20 nm, and more preferably 3 to 15 nm. As above-mentioned, the alkaline colloidal silica particles show the effect of inhibiting occurrence of the background contamination. Accordingly, the use of the alkaline colloidal silica particles is particularly preferable. Examples of the alkaline colloidal silica particles having the average particle size within the foregoing range include Snowtex-20 (average particle size: 10 to 20 nm), Snowtex-30 (average particle size: 10 to 20 nm), Snowtex-40 (average particle size: 10 to 20 nm), Snowtex-N (average particle size: 10 to 20 nm), Snowtex-S (average particle size: 8 to 11 nm) and Snowtex-XS (average particle size: 4 to 6 nm), each produced by Nissan Kagaku Co., Ltd.

The colloidal silica particles having an average particle size of not more than 20 nm, when used together with the necklace-shaped colloidal silica as described above, is particularly preferred, since porosity of the layer is maintained and the layer strength is further increased.

The ratio of the colloidal silica particles having an average particle size of not more than 20 nm to the necklace-shaped colloidal silica is preferably from 95/5 to 5/95, more preferably from 70/30 to 20/80, and most preferably from 60/40 to 30/70.

The hydrophilic layer of the planographic printing plate material of the invention contains porous metal oxide particles as metal oxides. Examples of the porous metal oxide particles include porous silica particles, porous aluminosilicate particles or zeolite particles as described later.

<Porous Silica or Porous Aluminosilicate Particles>

The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle size of such particles can be controlled by variation of the production conditions. The porous silica particles prepared from the gel by the wet method is particularly preferred.

The porous aluminosilicate particles can be prepared by the method described in, for example, JP O.P.I. No. 10-71764. Thus prepared aluminosilicate particles are amorphous complex particles synthesized by hydrolysis of aluminum alkoxide and silicon alkoxide as the major components. The particles can be synthesized so that the ratio of alumina to silica in the particles is within the range of from 1:4 to 4:1. Complex particles composed of three or more components prepared by an addition of another metal alkoxide may also be used in the invention. In such a particle, the porosity and the particle size can be controlled by adjustment of the production conditions.

The porosity of the particles is preferably not less than 1.0 ml/g, more preferably not less than 1.2 ml/g, and most preferably of from 1.8 to 2.5 ml/g, in terms of pore volume before the dispersion. The pore volume is closely related to water retention of the coated layer. As the pore volume increases, the water retention is increased, contamination is difficult to occur, and the water retention latitude is broad. Particles having a pore volume of more than 2.5 ml/g are brittle, resulting in lowering of durability of the layer containing them. Particles having a pore volume of less than 0.5 ml/g may be insufficient in printing performance.

<Zeolite Particles>

Zeolite is a crystalline aluminosilicate, which is a porous material having voids of a regular three dimensional net work structure and having a pore size of 0.3 to 1 nm. Natural and synthetic zeolites are expressed by the following formula.

$$(M_1\cdot(M_2)_{0.5})_m(Al_mSi_nO_{2(m+n)})\cdot xH_2O$$

In the above, $M_1$ and $M_2$ are each exchangeable cations. Examples of $M_1$ or $M_2$ include $Li^+$, $Na^+$, $K^+$, Tl+, $Me_4N^+$ (TMA), $Et_4N^+$ (TEA), $Pr_4N^+$ (TPA), $C_7H_{15}N^{2+}$, and $C_8H_{16}N^+$, and examples of $M^2$ include $Ca^{2+}$, $Mg^{2+}$, $Ba^{2+}$, $Sr^{2+}$ and $(C_8H_{18}N)_2{}^{2+}$. Relation of n and m is n≧m, and consequently, the ratio of m/n, or that of Al/Si is not more than 1. A higher Al/Si ratio shows a higher content of the exchangeable cation, and a higher polarity, resulting in higher hydrophilicity. The Al/Si ratio is within the range of preferably from 0.4 to 1.0, and more preferably 0.8 to 1.0. x is an integer.

Synthetic zeolite having a stable Al/Si ratio and a sharp particle size distribution is preferably used as the zeolite particles to be used in the invention. Examples of such zeolite include Zeolite A: $Na_{12}$ $(Al_{12}Si_{12}O_{48})\cdot 27H_2O$; Al/Si=1.0, Zeolite X: $Na_{86}(Al_{86}Si_{106}O_{384})\cdot 264H_2O$; Al/Si=0.811, and Zeolite Y: $Na_{56}(Al_{56}Si_{136}O_{384})\cdot 250H_2O$; Al/Si=0.412.

Containing the porous zeolite particles having an Al/Si ratio within the range of from 0.4 to 1.0 in the hydrophilic layer greatly raises the hydrophilicity of the hydrophilic layer itself, whereby contamination in the course of printing is inhibited and the water retention latitude is also increased. Further, contamination caused by a finger mark is also greatly reduced. When Al/Si is less than 0.4, the hydrophilicity is insufficient and the above-mentioned improving effects are lowered.

The hydrophilic matrix phase of the planographic printing plate material of the invention can contain layer structural clay mineral particles as a metal oxide. Examples of the layer structural clay mineral particles include a clay mineral such as kaolinite, halloysite, talk, smectite such as montmorillonite, beidellite, hectorite and saponite, vermiculite, mica and chlorite; hydrotalcite; and a layer structural polysilicate such as kanemite, makatite, ilerite, magadiite and kenyte. Among them, ones having a higher electric charge density of the unit layer are higher in the polarity and in the hydrophilicity. Preferable charge density is not less than 0.25, more preferably not less than 0.6. Examples of the layer structural mineral particles having such a charge density include smectite having a negative charge density of from 0.25 to 0.6 and bermiculite having a negative charge density of from 0.6 to 0.9. Synthesized fluorinated mica is preferable since one having a stable quality, such as the particle size, is available. Among the synthesized fluorinated mica, swellable one is preferable and one freely swellable is more preferable.

An intercalation compound of the foregoing layer structural mineral particles such as a pillared crystal, or one treated by an ion exchange treatment or a surface treatment such as a silane coupling treatment or a complication treatment with an organic binder is also usable.

With respect to the size of the planar structural mineral particles, the particles have an average particle size (an average of the largest particle length) of preferably not more than 20 μm, and more preferably not more than 10 μm, and an average aspect ratio (the largest particle length/the particle thickness of preferably not less than 20, and more preferably not less than 50, in a state contained in the layer including the case that the particles are subjected to a swelling process and a dispersing layer-separation process. When the particle size is within the foregoing range, continuity to the parallel direction, which is a trait of the layer structural particle, and softness, are given to the coated layer so that a strong dry layer in which a crack is difficult to be formed can be obtained. The coating solution containing the layer structural clay mineral particles in a large amount can minimize particle sedimentation due to a viscosity increasing effect. The particle size greater than the foregoing may produce a non-uniform coated layer, resulting in poor layer strength. The aspect ratio lower than the foregoing reduces the planar particles, resulting in insufficient viscosity increase and reduction of particle sedimentation inhibiting effect.

The content of the layer structural clay mineral particles is preferably from 0.1 to 30% by weight, and more preferably from 1 to 10% by weight based on the total weight of the layer. Particularly, the addition of the swellable synthesized fluorinated mica or smectite is effective if the adding amount is small. The layer structural clay mineral particles may be added in the form of powder to a coating liquid, but it is preferred that gel of the particles which is obtained by being swelled in water, is added to the coating liquid in order to obtain a good dispersity according to an easy coating liquid preparation method which requires no dispersion process comprising dispersion due to media.

An aqueous solution of a silicate is also usable as another additive to the hydrophilic matrix phase in the invention. An alkali metal silicate such as sodium silicate, potassium silicate or lithium silicate is preferable, and the $SiO_2/M_2O$ is preferably selected so that the pH value of the coating liquid after addition of the silicate exceeds 13 in order to prevent dissolution of the porous metal oxide particles or the colloidal silica particles.

An inorganic polymer or an inorganic-organic hybrid polymer prepared by a sol-gel method employing a metal alkoxide. Known methods described in S. Sakka "Application of Sol-Gel Method" or in the publications cited in the above publication can be applied to prepare the inorganic polymer or the inorganic-organic hybridpolymer by the sol-gel method.

In the invention, the hydrophilic matrix phase preferably contains a water soluble resin. Examples of the water soluble resin include polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone. In the invention, polysaccharides are preferably used as the water soluble resin.

As the polysaccharide, starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable. These polysaccharides can form a preferred surface shape of the hydrophilic layer.

The surface of the hydrophilic layer preferably has a convexoconcave structure having a pitch of from 0.1 to 50 μm such as the grained aluminum surface of an aluminum PS plate. The water retention ability and the image maintaining ability are raised by such a convexoconcave structure of the surface. Such a convexoconcave structure can also be formed by adding in an appropriate amount a filler having a suitable particle size to the coating liquid of the hydrophilic layer. However, the convexoconcave structure is preferably formed by coating a coating liquid for the hydrophilic layer containing the alkaline colloidal silica and the water-soluble polysaccharide so that the phase separation occurs at the time of drying the coated liquid, whereby a structure is obtained which provides a good printing performance.

The shape of the convexoconcave structure such as the pitch and the surface roughness thereof can be suitably controlled by the kinds and the adding amount of the alkaline colloidal silica particles, the kinds and the addition amount of the water-soluble polysaccharide, the kinds and the adding amount of another additive, a solid concentration of the coating liquid, a wet layer thickness or a drying condition.

In the invention, it is preferred that the water soluble resin contained in the hydrophilic matrix phase is water soluble, and at least a part of the resin exists in the hydrophilic layer in a state capable of being dissolved in water. If a water soluble carbon atom-containing material is cross-linked by a crosslinking agent and is insoluble in water, its hydrophilicity is lowered, resulting in problem of lowering printing performance. A cationic resin may also be contained in the hydrophilic layer. Examples of the cationic resin include a polyalkylene-polyamine such as a polyethyleneamine or polypropylenepolyamine or its derivative, an acryl resin having a tertiary amino group or a quaternary ammonium group and diacrylamine. The cationic resin may be added in a form of fine particles. Examples of such particles include the cationic microgel described in Japanese Patent O.P.I. Publication No. 6-161101.

A water-soluble surfactant may be added for improving the coating ability of the coating liquid for the hydrophilic layer in the invention. A silicon atom-containing surfactant and a fluorine atom-containing surfactant are preferably used. The silicon atom-containing surfactant is especially preferred in that it minimizes printing contamination. The content of the surfactant is preferably from 0.01 to 3% by weight, and more preferably from 0.03 to 1% by weight based on the total weight of the hydrophilic layer (or the solid content of the coating liquid).

The hydrophilic layer in the invention can contain a phosphate. Since a coating liquid for the hydrophilic layer is preferably alkaline, the phosphate to be added to the hydrophilic layer is preferably sodium phosphate or sodium monohydrogen phosphate. The addition of the phosphate provides improved reproduction of dots at shadow portions. The content of the phosphate is preferably from 0.1 to 5% by weight, and more preferably from 0.5 to 2% by weight in terms of amount excluding hydrated water.

The hydrophilic layer in the invention can contain a light heat conversion material as described later. When the material is in the particle form, the particle size is preferably less than 1 μm.

<Inorganic Particles or Inorganic Material Coated Particles Both Having a Particle Size Not Less Than 1 μm (Hereinafter Referred to Also as Particles in the Invention)>

Examples of the inorganic particles include well-known metal oxide particles include particles of silica, alumina, titania and zirconia. Porous metal oxide particles are preferably used in order to prevent sedimentation of the particles in a coating liquid. Examples of the porous metal oxide particles include the porous silica particles and the porous aluminosilicate particles described above.

The inorganic material coated particles include particles in which organic particles such as polymethyl methacrylate particles or polystyrene particles form cores and the cores are covered with inorganic particles having a size smaller than that of the cores. The particle size of the inorganic particles is preferably from 1/10 to 1/100 of that of the cores. Further, well-known metal oxide particles include particles of silica, alumina, titania and zirconia can be used as the inorganic particles. There are various covering methods, but a dry covering method is preferred in which the cores collide with the covering materials at high speed in air as in a hybridizer for the covering materials to penetrate the surface of the cores and fix them there.

Particles in which organic particles are plated with a metal can be used. Examples of such particles include Micropearl AU produced by Sekisui Kagaku Co., Ltd., in which resin particles are plated with a metal.

It is preferred that the particles in the invention have a particle size of not less than 1 μm, and satisfy inequality (1) described previously. The particle size is more preferably from 1 to 10 μm, still more preferably from 1.5 to 8 μm, and most preferably from 2 to 6 μm.

When the particle size exceeds 10 μm, it may lower dissolution of formed images or result in contamination of blanket during printing. In the invention, the content of the particles having a particle size of not less than 1 μm in the hydrophilic layer is suitably adjusted to satisfy the parameters regarding the invention, but is preferably from 1 to 50% by weight, and more preferably from 5 to 40% by weight, based on the hydrophilic layer. The content of materials containing a carbon atom such as the organic resins or carbon black in the hydrophilic layer is preferably lower in increasing hydrophilicity of the hydrophilic layer. The total content of these materials in the hydrophilic layer is preferably less than 9% by weight, and more preferably less than 5% by weight.

[Under Layer]

In the invention, when an under layer is provided, materials used in the under layer include the same materials as in the hydrophilic layer described previously. The under layer, which is porous, is less advantageous. The under layer is preferably non-porous. The porosity providing agent content of the under layer is preferably lower than that of the hydrophilic layer in view of strength of the under layer. It is more preferable that the under layer contains no porosity providing agent.

The content of the particles having a particle size of not less than 1 μm in the under layer is suitably adjusted to satisfy the parameters regarding the invention, but is preferably from 1 to 50% by weight, and more preferably from 5 to 40% by weight, based on the under layer.

Like the hydrophilic layer, the content of materials containing a carbon atom such as the organic resins or carbon black in the under layer is preferably lower in increasing hydrophilicity of the under layer. The total content of these materials in the under layer is preferably less than 9% by weight, and more preferably less than 5% by weight.

[Support]

As the support in the invention, those well known in the art as supports for printing plates can be used. Examples of the support include a metal plate, a plastic film, paper treated with polyolefin, and composite materials such as laminates thereof. The thickness of the support is not specifically limited as long as a printing plate having the support can be mounted on a printing press, and is advantageously from 50 to 500 μm in easily handling.

Examples of the metal plate include iron, stainless steel, and aluminum. Aluminum is especially preferable in its gravity and stiffness. Aluminum is ordinarily used after degreased with an alkali, an acid or a solvent to remove oil on the surface, which has been used when rolled and wound around a spool. The degreasing is carried out preferably employing an aqueous alkali solution. In order to increase adhesion between the support and a coating layer, it is preferred that the surface of the support is subjected to adhesion increasing treatment or is coated with a subbing layer. For example, the support is immersed in a solution containing silicate or a coupling agent such as a silane coupling agent, or the support is coated with the solution and then sufficiently dried. Anodization treatment is considered to be one kind of adhesion increasing treatment, and can be used. The anodization treatment and the immersing or coating treatment described above can be combined. Aluminum plate, which is surface-roughened with a conventional method, can be used.

Examples of the plastic film include a polyethylene terephthalate film, a polyethylene naphthalate film, a polyimide film, a polyamide film, a polycarbonate film, a polysulfone film, a polyphenylene oxide film, and a cellulose ester film. The plastic film is preferably a polyethylene terephthalate film, or a polyethylene naphthalate film. In order to increase adhesion between the support and a coating layer, it is preferred that the surface of the plastic film is subjected to adhesion increasing treatment or is coated with a subbing layer. Examples of the adhesion increasing treatment include corona discharge treatment, flame treatment, plasma treatment and UV light irradiation treatment. The subbing layers include a layer containing gelatin or latex.

The composite support can be obtained suitably laminating the above supports. Laminating may be carried out before or after forming a coating layer. Further, laminating may be carried out immediately before mounting it on a printing press.

EXAMPLES

The present invention will be explained below employing examples, but is not limited thereto.

<<Preparation of Support>>

(Preparation of Support 1)

A subbing layer for coating an aqueous coating liquid is provided on a 175 μm thick polyethylene terephthalate film HS74 (produced by Teijin Co., Ltd.). Thus, the support 1 was prepared.

(Preparation of Support 2)

A 0.24 mm thick aluminum plate (1050, H16) was immersed in an aqueous 1% by weight sodium hydroxide solution at 50° C. to give an aluminum dissolution amount of 2 g/m$^2$, washed with water, immersed in an aqueous 0.1% by weight hydrochloric acid solution at 25° C. for 30 seconds to neutralize, and then washed with water. Subsequently, the aluminum plate was subjected to an electrolytic surface-roughening treatment in an electrolytic solution containing 10 g/liter of hydrochloric acid and 0.5 g/liter of aluminum at a peak current density of 50 A/dm$^2$ employing an alternating current with a sine waveform, in which the distance between the plate surface and the electrode was 10 mm. The electrolytic surface-roughening treatment was divided into 10 treatments, in which the quantity of electricity used in one treatment (at a positive polarity) was 40 C/dm$^2$, and the total quantity of electricity used (at a positive polarity) was 400 C/dm$^2$. Standby time of 4 seconds, during which no surface-roughening treatment was carried out, was provided after each of the separate electrolytic surface-roughening treatments. Subsequently, the resulting aluminum plate was immersed in an aqueous 1% by weight sodium hydroxide solution at 50° C. and etched to give an aluminum etching amount (including smut produced on the surface) of 2.0 g/m$^2$, washed with water, neutralized in an aqueous 10% by weight sulfuric acid solution at 25° C. for 10 seconds, and washed with water. Subsequently, the aluminum plate was subjected to anodizing treatment in an aqueous 20% by weight sulfuric acid solution at a constant voltage of 20 V, in which a quantity of electricity of 150 C/dm$^2$ was supplied, and washed with water. The washed surface of the plate was squeegeed, and the plate was immersed in an aqueous 1% by weight sodium silicate No. 5 solution at 70° C. for 30 seconds, washed with water, and dried at 80° C. for 5 minutes. Thus, the support 2 was prepared.

<<Preparation of Planographic Printing Plate Material>>

<Preparation of Coating Solution>

[Preparation of Microcapsule Dispersion]

A water-based solution was prepared in which 10 g of PVA-205 with a saponification degree of 86.5 to 89.0 mol % (produced by Kuraray Co., Ltd.) were dissolved in 165 g of pure water. An oil-based solution was prepared in which 10 g of hexamethylene diisocyanate, 2 g of diethylenetriamine and 10 g of polystyrene particles (with an average particle size of 0.1 μm) were dissolved in 78 g of d-limonene. The oil-based solution was added to the water-based solution while vigorously stirring, and emulsified at a rotation speed of 10,000 rpm in a homogenizer pure water. The resulting mixture was gradually heated at 80° C. while weakly stirring, maintained at 80° C. for 60 minutes, then cooled to room temperature to obtain a microcapsule dispersion containing 40% by weight of microcapsules. The average particle size of the microcapsules was 1.0 μm.

[Preparation of Image Formation Layer Coating Solution]

Materials as shown in Table 2 were mixed with vigorous stirring, and filtered to obtain image formation layer coating solutions 1 to 4. In Table 2, numerical number represents parts by weight.

TABLE 2

| Material No. used | Image formation layer coating solution 1 | Image formation layer coating solution 2 | Image formation layer coating solution 3 | Image formation layer coating solution 4 |
|---|---|---|---|---|
| 1 | — | — | 10.5 | 10.5 |
| 2 | — | 12 | — | — |
| 3 | 11.25 | — | — | — |
| 4 | 12 | 15 | 15 | 18 |
| 5 | 0.3 | 0.3 | 0.3 | — |

TABLE 2-continued

| Material No. used | Image formation layer coating solution 1 | Image formation layer coating solution 2 | Image formation layer coating solution 3 | Image formation layer coating solution 4 |
|---|---|---|---|---|
| Pure water | 76.45 | 72.7 | 74.2 | 71.5 |
| Solid Content (weight %) | 6 | 6 | 6 | 6 |

Details of the material in Table 2 are as follows.

1: Carnauba wax emulsion A118 (the wax having an average particle size of 0.3 μm, and having a solid content of 40% by weight, produced by Gifu Shellac Co., Ltd.)

2: Acrylonitrile-styrene-alkyl acrylate-methacrylic acid copolymer emulsion Jodosol GD87B (having an average particle size of 90 nm and a solid content of 35% by weight, produced by Nippon NSC Co., Ltd.)

3: Microcapsule dispersion (having an average particle size of 1.0 μm and a solid content of 40% by weight)

4: Aqueous solution of trehalose powder Treha (mp. 97° C., produced by Hayashihara Shoji Co., Ltd.) having a solid content of 10% by weight 5: Light-to-heat conversion dye ADS830WS (Produced by American Dye Source Co., Ltd.)

[Preparation of Hydrophilic Layer Coating Solution]

Materials as shown in Table 3 were mixed with vigorous stirring in a homogenizer, and filtered to obtain hydrophilic layer coating solutions 1 and 2. In Table 3, numerical number represents parts by weight.

TABLE 3

| Material No. used | Hydrophilic layer coating solution 1 | Hydrophilic layer coating solution 2 |
|---|---|---|
| *1 | 5.74 | 6.21 |
| *2 | 12.92 | 13.97 |
| *3 | 1.75 | 1.75 |
| *4 | 2.8 | 2.8 |
| *5 | 1.75 | 1.75 |
| *6 | 0.35 | 0.35 |
| *7 | 0.7 | 0.7 |
| *8 | — | 0.7 |
| *9 | 1.05 | — |
| Pure water | 72.95 | 71.78 |
| Solid content (% by weight) | 7 | 7 |

*1: Colloidal silica (alkali type): Snowtex S (solid 30% by weight, produced by Nissan Kagaku Co., Ltd.)

*2: Necklace shaped colloidal silica (alkali type): Snowtex PSM (solid 20% by weight, produced by Nissan Kagaku Co., Ltd.)

*3: Cu—Fe—Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40.5% by weight (including 0.5% by weight of dispersant)}

*4: Layer structural clay mineral particles: Montmorillonite Mineral Colloid MO gel prepared by vigorously stirring montmorillonite Mineral Colloid MO; gel produced by Southern Clay Products Co., Ltd. (average particle size: 0.1 μm) in water in a homogenizer to give a solid content of 5% by weight

*5: Aqueous 4% by weight sodium carboxymethyl cellulose solution (Reagent produced by Kanto Kagaku Co., Ltd.)

*6: Aqueous 10% by weight sodium phosphate·dodecahydrate solution (Reagent produced by Kanto Kagaku Co., Ltd.)

*7: Porous metal oxide particles Silton AMT 08 (porous aluminosilicate particles having an average particle size of 0.6 μm, produced by Mizusawa Kagaku Co., Ltd.)

*8: Porous metal oxide particles Silton JC 20 (porous aluminosilicate particles having an average particle size of 2 μm, produced by Mizusawa Kagaku Co., Ltd.)

*9: Porous metal oxide particles Silton JC 30 (porous aluminosilicate particles having an average particle size of 3 μm, produced by Mizusawa Kagaku Co., Ltd.) (Preparation of under layer coating liquid)

[Preparation of Under Layer Coating Solution]

Materials as shown in Table 4 were mixed in a homogenizer while vigorously stirring, and filtered to obtain under layer coating solution 1. In Table 4, numerical number represents parts by weight.

TABLE 4

| Materials used | Under layer coating solution 1 |
|---|---|
| Colloidal silica (alkali type): Snowtex XS (solid 20% by weight, produced by Nissan Kagaku Co., Ltd.) | 33.25 |
| Cu—Fe—Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40.5% by weight (including 0.5% by weight of dispersant)} | 2.5 |
| Layer structural clay mineral particles: Montmorillonite Mineral Colloid MO gel prepared by vigorously stirring montmorillonite Mineral Colloid MO; gel produced by Southern Clay Products Co., Ltd. (average particle size: 0.1 μm) in water in a homogenizer to give a solid content of 5% by weight | 4 |
| Aqueous 4% by weight sodium carboxymethyl cellulose solution (Reagent produced by Kanto Kagaku Co., Ltd.) | 2.5 |
| Aqueous 10% by weight sodium phosphate·dodecahydrate solution (Reagent produced by Kanto Kagaku Co., Ltd.) | 0.5 |
| Porous metal oxide particles Silton JC 50 (porous aluminosilicate particles having an average particle size of 5 μm, produced by Mizusawa Kagaku Co., Ltd.) | 2 |
| Pure water | 55.25 |
| Solid content (% by weight) | 10 |

<Preparation of Planographic Printing Plate Material Sample>

The coating solution as shown in Table 5 was coated on the support obtained above employing a wire bar. The wire bar was employed so as to obtain a layer thickness as shown in Table 5. The coated under layer and the coated hydrophilic layer were dried at 100° C. for ten minutes, and the coated image formation layer was dried at 50° C. for three minutes. In samples having a hydrophilic layer, the hydrophilic layer coating solution was coated, dried, subjected to aging treatment at 60° C. for 24 hours, and then the image formation layer coating solution was coated. The coated image formation layer was dried and further subjected to aging treatment at 40° C. for 48 hours. Thus, planographic printing plate material sample Nos. 1 through 5 were obtained.

TABLE 5

| Sample No. | Support No. | Under layer coating solution No. | Under layer coating amount ($g/m^2$) | Hydrophilic layer coating solution No. | Hydrophilic layer coating amount ($g/m^2$) | Image formation layer coating solution No. | Image formation layer coating amount ($g/m^2$) |
|---|---|---|---|---|---|---|---|
| 1 | 2 | None | — | None | — | 1 | 0.6 |
| 2 | 2 | None | — | None | — | 2 | 0.6 |
| 3 | 2 | None | — | None | — | 3 | 0.6 |
| 4 | 1 | None | — | 1 | 2.5 | 4 | 0.6 |
| 5 | 1 | 1 | 2.5 | 2 | 0.8 | 4 | 0.6 |

<Image Formation According to Infrared Laser>

The resulting planographic printing plate material sample was mounted on an exposure drum of a printing press. Image formation was carried out by infrared laser exposure. Exposure was carried out employing an infrared laser (having a wavelength of 830 nm and a beam spot diameter of 18 μm) at an exposure energy of 300 $mJ/cm^2$, at a resolution of 2400 dpi and at a screen line number of 175 to form a solid image and a dot image with an dot area of 1 to 99%. The term, "dpi" shows the number of dots per 2.54 cm.

(Printing Method)

The exposed planographic printing plate material sample was mounted on a plate cylinder of a printing press, DAIYA 1F-1 produced by Mitsubishi Jukogyo Co., Ltd. Printing was carried out employing a coated paper, dampening water, a 2% by weight solution of Astromark 3 (produced by Nikken Kagaku Kenkyusyo Co., Ltd.), and printing ink (Toyo King Hyecho M Magenta, produced by Toyo Ink Manufacturing Co.).

Eighty liters of dampening water were prepared and stored in a dampening water supply tank. The dampening water was supplied from the supply tank to the dampening water boat of the printing press, and the dampening water overflowing the dampening water boat was re-circulated while cooling and reused. When the dampening water was filtered during re-circulation, a filter as described later was set in the path from the supply tank to the dampening water boat.

<<Evaluation>>

[Initial Printability]

Printing was carried out in the same manner as sequence carried out in the conventional PS plate, and the number of paper sheets printed from when printing started to when print without stain at non-image portions, with a reproduced dot image with a dot area of 95% and with a solid image having an ink density of not less than 1.6 was obtained was counted and evaluated as a measure of initial printability.

[Water Tolerance]

After five hundred copies were printed, printing was continued gradually reducing supplied amount of the dampening water, and the supplied amount producing filling-up at a dot image with a dot area of 90% was determined and evaluated as a measure of water tolerance. The supplied amount was represented by a relative value when an optimum supplied amount of dampening water was set at 100.

Experiment 1

Experiment 1-1. Printing was carried out employing an exposed planographic printing plate material sample 1, where printing started employing a fresh dampening water without contamination, provided that the dampening water was not filtered.

The results were as follows.

Initial printability was 10 (sheets), and water tolerance was 70.

Experiment 1-2. Next, the image formation layer coating solution 1 (containing microcapsules with an average particle size of 1.0 μm) was added to the dampening water supply tank to give a solid content of 60 g, and mixed with stirring to obtain a contaminated dampening water. Printing was carried out employing an exposed planographic printing plate material sample 1, where printing started employing the contaminated dampening water obtained above, provided that the dampening water was not filtered.

The results were as follows.

Initial printability was 13 (sheets), and water tolerance was 75, which exhibited results inferior to the above.

Experiment 1-3. Printing was carried out employing an exposed planographic printing plate material sample 1, where printing started employing the contaminated dampening water obtained above, provided that the dampening water was filtered employing a filter. The filter used was Ultipleat Profile 020 (which can remove 90% of particles with a particles size of 1.0 μm) produced by Nihon Pall Co., Ltd.

The results were as follows.

Initial printability was 10 (sheets), and water tolerance was 70, which exhibited the same results as Experiment 1-1 above.

Experiment 2

Experiment 2-1. Printing was carried out employing an exposed planographic printing plate material sample 2, where printing started employing a fresh dampening water without contamination, provided that the dampening water was not filtered.

The results were as follows.

Initial printability was 10 (sheets), and water tolerance was 70.

Experiment 2-2. Next, the image formation layer coating solution 2 (containing microcapsules with an average particle size of 90 nm) was added to the dampening water supply tank to give a solid content of 60 g, and mixed with stirring to obtain a contaminated dampening water. Printing was carried out employing an exposed planographic printing plate material sample 2, where printing started employing the contaminated dampening water obtained above, provided that the dampening water was not filtered.

The results were as follows.

Initial printability was 20 (sheets), and water tolerance was 80, which exhibited poor results.

Experiment 2-3. Printing was carried out employing an exposed planographic printing plate material sample 2, where printing started employing the contaminated dampening water obtained above, provided that the dampening water was filtered employing a filter. The filter used was Ultipleat Profile 020 (which can remove 90% of particles with a particles size of 1.0 μm) produced by Nihon Pall Co., Ltd.

The results were as follows.

Initial printability was 18 (sheets), and water tolerance was 80, which exhibited results inferior to Experiment 2-1 above.

Experiment 2-4. Printing was carried in the same manner as in Experiment 2-3 above, except that a filter produced by Nihon Pall Co., Ltd. was used which employed a crossflow type filter membrane. The results were as follows.

Initial printability was 10 (sheets), and water tolerance was 70, which exhibited the same results as Experiment 2-1 above.

Experiment 3

Experiment 3-1. Printing was carried out employing an exposed planographic printing plate material sample 3, where printing started employing a fresh dampening water without contamination, provided that the dampening water was not filtered. The results were as follows.

Initial printability was 10 (sheets), and water tolerance was 70.

Experiment 3-2. Next, the image formation layer coating solution 3 (containing microcapsules with an average particle size of 0.3 μm) was added to the dampening water supply tank to give a solid content of 60 g, and mixed with stirring to obtain a contaminated dampening water. Printing was carried out employing an exposed planographic printing plate material sample 3, where printing started employing the contaminated dampening water obtained above, provided that the dampening water was not filtered. The results were as follows.

Initial printability was 15 (sheets), and water tolerance was 75, which exhibited a little poor results.

Experiment 3-3. Printing was carried out employing an exposed planographic printing plate material sample 3, where printing started employing the contaminated dampening water obtained above, provided that the dampening water was filtered employing a filter. The filter used was Zeta Plus 90S produced by Cuno Co., Ltd., having adsorption filtration ability due to zeta potential, (which can remove particles with a particles size of from 0.1 to 0.2 μm). The results were as follows.

Initial printability was 10 (sheets), and water tolerance was 70, which exhibited the same results as Experiment 3-1 above.

Experiment 3-4. Printing was carried out in the same manner as in Experiment 3-3, except that an exposed planographic printing plate material sample 4 was used. The results were as follows.

Initial printability was 10 (sheets), and water tolerance was 70, which exhibited good results.

Experiment 3-5. Printing was carried out in the same manner as in Experiment 3-3, except that an exposed planographic printing plate material sample 5 was used. The results were as follows.

Initial printability was 10 (sheets), and water tolerance was 70, which exhibited good results.

As is apparent from the above, the printing method of the invention provides stable printing conditions even when a planographic printing plate material is subjected to development on-press, and a part of the image formation layer is introduced to be accumulated in the dampening water.

EFFECT OF THE INVENTION

The present invention can provide a printing method of carrying out printing employing a planographic printing plate material capable of being developed on a printing press, which can maintain stable printing conditions even when a dampening water is re-circulated and reused.

What is claimed is:

1. A printing method employing a planographic printing plate material capable of being developed on a printing press, the method comprising the steps of:

imagewise exposing a planographic printing plate material comprising a support, and provided thereon, an image formation layer containing hydrophobic precursor particles;

developing the exposed planographic printing plate material with dampening water or both dampening water and printing ink to obtain a printing plate, the dampening water for said developing being re-circulated for re-use and filtered with a filter during re-circulation; and carrying out printing employing the resulting printing plate.

2. The printing method of claim 1, wherein the hydrophobic precursor particles are thermoplastic particles or microcapsules encapsulating oleophilic materials therein.

3. The printing method of claim 1, wherein a filtration accuracy of the filter is not more than the average particle size of the hydrophobic precursor particles.

4. The printing method of claim 1, wherein the filter employs an adsorption ability due to zeta potential, whereby the dampening water is filtered.

5. The printing method of claim 1, wherein the filter employs an ultrafiltration method, whereby the dampening water is filtered.

6. The printing method of claim 1, wherein the imagewise exposing is carried out employing an infrared laser installed in a printing press.

7. The printing method of claim 1, wherein the image formation layer contains the hydrophobic precursor particles in an amount of from 5 to 100% by weight.

8. The method of claim 1, wherein the image formation layer further contains a water soluble resin.

9. The method of claim 8, wherein the water soluble resin is oligosaccharide.

10. The method of claim 9, wherein the oligosaccharide is trehalose.

* * * * *